US010473289B2

(12) United States Patent
Kim

(10) Patent No.: US 10,473,289 B2
(45) Date of Patent: Nov. 12, 2019

(54) LIGHTING DEVICE

(71) Applicant: LG INNOTEK CO., LTD., Seoul (KR)

(72) Inventor: Eun Hwa Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/766,748

(22) PCT Filed: Sep. 7, 2016

(86) PCT No.: PCT/KR2016/010011

§ 371 (c)(1),
(2) Date: Apr. 6, 2018

(87) PCT Pub. No.: WO2017/061704

PCT Pub. Date: Apr. 13, 2017

(65) Prior Publication Data

US 2018/0292067 A1 Oct. 11, 2018

(30) Foreign Application Priority Data

Oct. 7, 2015 (KR) ..... 10-2015-0140712

(51) Int. Cl.

| | |
|---|---|
| ***F21V 5/00*** | (2018.01) |
| ***F21V 5/04*** | (2006.01) |
| *F21V 29/76* | (2015.01) |
| *F21Y 115/10* | (2016.01) |

(52) U.S. Cl.

CPC ..... *F21V 5/008* (2013.01); *F21V 5/04* (2013.01); *F21V 29/767* (2015.01); *F21Y 2115/10* (2016.08)

(58) Field of Classification Search

CPC ..... F21V 5/008; F21V 5/04; F21V 29/767; F21Y 2115/10

USPC ..... 250/504 R

See application file for complete search history.

(56) References Cited

U.S. PATENT DOCUMENTS

| | | | | |
|---|---|---|---|---|
| 7,023,622 | B2 | 4/2006 | Liang | |
| 2005/0270527 | A1 | 12/2005 | Reel | |
| 2009/0080086 | A1 * | 3/2009 | Shafer | G02B 13/143 359/651 |
| 2010/0208487 | A1 | 8/2010 | Li | |
| 2010/0296090 | A1 * | 11/2010 | Hallstein | G01J 3/02 356/328 |

* cited by examiner

FOREIGN PATENT DOCUMENTS

| | | | |
|---|---|---|---|
| KR | 10-2014-0035145 | A | 3/2014 |
| KR | 10-1374863 | B1 | 3/2014 |
| WO | WO 2006/074656 | A1 | 7/2006 |

*Primary Examiner* — Michael Maskell

(74) *Attorney, Agent, or Firm* — Birch, Stewart, Kolasch & Birch, LLP

(57) ABSTRACT

Embodiments include: a light emitting diode for emitting light; and a lens array including first to fourth lenses sequentially arranged in line in a first direction, wherein the first to fourth lenses are each convex lenses, the first lens and the fourth lens are the same in shape, the second lens and the third lens are the same in shape, the first and second lenses are each arranged in convex configurations in the first direction, the third and fourth lenses are each arranged in convex configurations in the direction opposite to the first direction, and the first direction is a direction oriented toward the first lens from the light emitting diode.

19 Claims, 6 Drawing Sheets

| Light source diameter(S1) | | 2.5 | A | 0.4 A | 0.5 A | 0.6 A | 0.7 A | 0.8 A | 0.9 A | 1.0 A | 1.1 A | 1.2 A | 1.3 A | 1.4 A | 1.5 A |
|---|---|---|---|---|---|---|---|---|---|---|---|---|---|---|---|
| First Lens | Diameter | 10 | 4.00 A | 1.60 A | 2.00 A | 2.40 A | 2.80 A | 3.20 A | 3.60 A | 4.00 A | 4.40 A | 4.80 A | 5.20 A | 5.60 A | 6.00 A |
| | Thickness | 4 | 1.60 A | 0.64 A | 0.80 A | 0.96 A | 1.12 A | 1.28 A | 1.44 A | 1.60 A | 1.76 A | 1.92 A | 2.08 A | 2.24 A | 2.40 A |
| | Radius | 4.75 | 1.90 A | 0.76 A | 0.95 A | 1.14 A | 1.33 A | 1.52 A | 1.71 A | 1.90 A | 2.09 A | 2.28 A | 2.47 A | 2.66 A | 2.85 A |
| | Conic constant | -0.639 | | | | | | | | | | | | | |
| Distance | d4 | 1 | 0.40 A | 0.16 A | 0.20 A | 0.24 A | 0.28 A | 0.32 A | 0.36 A | 0.40 A | 0.44 A | 0.48 A | 0.52 A | 0.56 A | 0.60 A |
| | d1 | 3.5 | 1.40 A | 0.56 A | 0.70 A | 0.84 A | 0.98 A | 1.12 A | 1.26 A | 1.40 A | 1.54 A | 1.68 A | 1.82 A | 1.96 A | 2.10 A |
| | d2 | 0.5 | 0.20 A | 0.08 A | 0.10 A | 0.12 A | 0.14 A | 0.16 A | 0.18 A | 0.20 A | 0.22 A | 0.24 A | 0.26 A | 0.28 A | 0.30 A |
| Second Lens | Diameter | 25 | 10.00 A | 4.00 A | 5.00 A | 6.00 A | 7.00 A | 8.00 A | 9.00 A | 10.00 A | 11.00 A | 12.00 A | 13.00 A | 14.00 A | 15.00 A |
| | Thickness | 10.5 | 4.20 A | 1.68 A | 2.10 A | 2.52 A | 2.94 A | 3.36 A | 3.78 A | 4.20 A | 4.62 A | 5.04 A | 5.46 A | 5.88 A | 6.30 A |
| | Radius | 10.45 | 4.18 A | 1.67 A | 2.09 A | 2.51 A | 2.93 A | 3.34 A | 3.76 A | 4.18 A | 4.60 A | 5.02 A | 5.43 A | 5.85 A | 6.27 A |
| Distance | d3 | 3.5 | 1.40 A | 0.56 A | 0.70 A | 0.84 A | 0.98 A | 1.12 A | 1.26 A | 1.40 A | 1.54 A | 1.68 A | 1.82 A | 1.96 A | 2.10 A |
| | d5 | 2.5 | 1.00 A | 0.40 A | 0.50 A | 0.60 A | 0.70 A | 0.80 A | 0.90 A | 1.00 A | 1.10 A | 1.20 A | 1.30 A | 1.40 A | 1.50 A |

FIG.5

| S1 | Front | Back | Center |
|---|---|---|---|
| 1.7 A | 47.6% | 55.5% | 62.0% |
| 1.6 A | 49.4% | 56.4% | 62.9% |
| 1.5 A | 51.3% | 57.4% | 63.8% |
| 1.4 A | 53.1% | 58.4% | 64.7% |
| 1.3 A | 55.0% | 59.4% | 65.6% |
| 1.2 A | 56.8% | 60.4% | 66.4% |
| 1.1 A | 58.5% | 61.3% | 67.0% |
| 1.0 A | 60.2% | 62.2% | 67.6% |
| 0.9 A | 61.7% | 62.9% | 67.9% |
| 0.8 A | 63.0% | 63.4% | 68.0% |
| 0.7 A | 64.0% | 63.5% | 67.5% |
| 0.6 A | 64.1% | 62.6% | 66.1% |
| 0.5 A | 62.5% | 59.5% | 62.9% |
| 0.4 A | 55.6% | 52.3% | 55.5% |
| 0.375 A | 52.3% | 49.8% | 52.0% |
| 0.350 A | 48.1% | 46.5% | 47.7% |
| 0.3 A | 36.1% | 36.6% | 36.5% |

FIG.7

| C \ Sort | Front | Back | Center |
|---|---|---|---|
| -0.42 | 67.10% | 49.10% | 61.20% |
| -0.44 | 67.20% | 50.10% | 61.90% |
| -0.46 | 67.10% | 51.20% | 62.60% |
| -0.48 | 66.80% | 52.40% | 63.40% |
| -0.5 | 66.50% | 53.60% | 64.00% |
| -0.52 | 65.90% | 54.90% | 64.70% |
| -0.54 | 65.20% | 56.20% | 65.20% |
| -0.56 | 64.40% | 57.50% | 65.60% |
| -0.58 | 63.40% | 58.80% | 66.00% |
| -0.6 | 62.20% | 60.00% | 66.10% |
| -0.62 | 60.90% | 61.10% | 66.10% |
| -0.64 | 59.50% | 62.10% | 65.80% |
| -0.66 | 57.90% | 63.00% | 65.40% |
| -0.68 | 56.10% | 63.70% | 64.60% |
| -0.7 | 54.20% | 64.20% | 63.60% |
| -0.72 | 52.10% | 64.50% | 62.30% |
| -0.73 | 51.00% | 64.50% | 61.50% |
| -0.74 | 49.90% | 64.50% | 60.70% |
| -0.78 | 45.00% | 63.80% | 56.30% |

FIG.8

| S1 | Ø 2.5mm | Ø 5.0mm | Ø 10.0mm |
|---|---|---|---|
| Front | 60.2% | 60.1% | 59.8% |
| Back | 62.2% | 62.0% | 61.6% |
| Center | 67.6% | 67.4% | 67.0% |

FIG.9

| | S1 | S1 = A | A = 2.5mm | A = 5.0mm | A = 10.0mm |
|---|---|---|---|---|---|
| First Lens | Diameter | 2.0 A~ 6.0 A | 10 | 20 | 40 |
| | Thickness | 0.8 A ~ 2.4 A | 4 | 8 | 16 |
| | Radius | 0.9 A ~ 2.8 A | 4.7075 | 9.415 | 18.83 |
| | Conic constant | -0.44 ~ -0.73 | 0.639 | -0.639 | -0.639 |
| Second Lens | Diameter | 5.0 A ~ 15.0 A | 25 | 50 | 100 |
| | Thickness | 2.1 A ~ 6.3 A | 10.5 | 21 | 42 |
| | Radius | 2.1 A ~ 6.3 A | 10.4615 | 20.923 | 41.846 |
| | Conic constant | -0.44 ~ -0.73 | 0.641 | -0.641 | -0.641 |

LIGHTING DEVICE

CROSS REFERENCE TO RELATED APPLICATIONS

This application is the National Phase of PCT International Application No. PCT/KR2016/010011, filed on Sep. 7, 2016, which claims priority under 35 U.S.C. 119(a) to Patent Application No. 10-2015-0140712, filed in the Republic of Korea on Oct. 7, 2015, all of which are hereby expressly incorporated by reference into the present application.

TECHNICAL FIELD

Embodiments relate to a lighting device.

BACKGROUND ART

In general, a light-emitting diode (hereinafter referred to as an "LED") is an element that emits light when electrons and holes meet each other in a P-N semiconductor junction in response to the application of current, and has many advantages, such as continuous emission with low current and low power consumption.

In particular, such an LED is widely used in various display devices, a backlight light source, and the like. In recent years, a technology of emitting white light via wavelength conversion by using three light-emitting diode chips, which respectively emit red, green, and blue light, or by using phosphors, has been developed and the application range thereof has also been expanded to lighting devices.

A lighting device may include a lens array having various shapes of lenses in order to concentrate light and transmit the same to a target. In general, a plastic lens is used as a lens array depending on the characteristics of the application and a light source.

However, in the case of an application using an UV LED, since the plastic lens is damaged by ultraviolet light, a glass lens is used in the application using ultraviolet light, instead of a plastic lens. Such a glass lens requires a large mold for molding. In addition, since various molds are required in order to produce various shapes of glass lenses for light concentration, manufacturing costs are increased.

TECHNICAL OBJECT

Embodiments provide a lighting device that is capable of obtaining total cumulative power equal to or greater than 60% and is also capable of reducing manufacturing costs.

Technical Solution

A lighting device according to an embodiment includes a light-emitting element configured to emit light, and a lens array including first to fourth lenses sequentially arranged in a line in a first direction, wherein each of the first to fourth lenses is a convex lens, the first lens and the fourth lens have the same shape, and the second lens and the third lens have the same shape, wherein each of the first and second lenses is arranged with a convex shape facing the first direction, wherein each of the third and fourth lenses is arranged with a convex shape facing a direction opposite the first direction, and wherein the first direction is a direction from the light-emitting element toward the first lens.

The first lens and the fourth lens may have the same diameter, thickness, and curvature, and the second lens and the third lens may have the same diameter, thickness, and curvature.

The diameter of the first lens may be smaller than the diameter of the second lens.

The diameter of the first lens may range from 2.00 A to 6.00 A, the diameter of the second lens may range from 4.00 A to 15.00 A, and "A" may be the diameter of a light emission surface of the light-emitting element.

The thickness of the first lens may range from 0.80 A to 2.40 A, the thickness of the second lens may range from 1.68 A to 6.30 A, and "A" may be the diameter of a light emission surface of the light-emitting element.

Each of the first and second lenses may have an elliptical shape, and the conic constant of each of the first and second lenses may range from −0.44 to −0.73.

The distance between a light emission surface of the light-emitting element and the first lens may range from 0.16 A to 0.60 A, the distance between the fourth lens and a target may range from 0.40 A to 1.50 A, and "A" is the diameter of the light emission surface of the light-emitting element.

The distance between the first lens and the second lens may range from 0.56 A to 2.10 A, the distance between the second lens and the third lens may range from 0.08 A to 0.30 A, the distance between the third lens and the fourth lens may range from 0.56 A to 2.10 A, and "A" may be the diameter of a light emission surface of the light-emitting element.

The distance between the second lens and the third lens may be smaller than a distance between the first lens and the second lens.

The curvature of the first lens may range from 0.95 A to 2.85 A, the curvature of the second lens may range from 1.67 A to 6.27 A, and "A" may be the diameter of a light emission surface of the light-emitting element.

The diameter of the first lens may be 4.00 A, the diameter of the second lens may be 10.00 A, the curvature of the first lens may be 1.60 A, the curvature of the second lens may be 4.18 A, and "A" may be the diameter of a light emission surface of the light-emitting element.

The distance between a light emission surface of the light-emitting element and the first lens may be 0.40 A, the distance between the first lens and the second lens may be 1.40 A, the distance between the second lens and the third lens may be 0.20 A, the distance between the third lens and the fourth lens may be 1.40 A, and "A" may be the diameter of a light emission surface of the light-emitting element.

The light-emitting element may generate ultraviolet light in a wavelength range from 200 nm to 400 nm.

A lighting device according to another embodiment includes a light-emitting module including a circuit board and a light-emitting element disposed on the circuit board, and a lens array including first to fourth lenses sequentially arranged in a line in a first direction, wherein each of the first to fourth lenses is a convex lens, wherein each of the first and second lenses is arranged with a convex shape facing the first direction, wherein each of the third and fourth lenses is arranged with a convex shape facing a direction opposite the first direction, wherein the first lens and the fourth lens have the same shape, and the second lens and the third lens have the same shape, wherein the first direction is a direction from the light-emitting element toward the first lens, wherein the diameter of the first lens is smaller than the diameter of the second lens, wherein the first distance between the light-emitting element and the first lens is smaller than a second distance between the first lens and the second lens, wherein the third distance between the second lens and the third lens is smaller than the second distance, and wherein the fourth distance between the third lens and the fourth lens is the same as the second distance.

The diameter of the first lens may range from 2.00 A to 6.00 A, the diameter of the second lens may range from 4.00 A to 15.00 A, the thickness of the first lens may range from 0.80 A to 2.40 A, the thickness of the second lens may range from 1.68 A to 6.30 A, the curvature of the first lens may range from 0.95 A to 2.85 A, the curvature of the second lens may range from 1.67 A to 6.27 A, and "A" may be the diameter of a light emission surface of the light-emitting element.

The first distance may range from 0.16 A to 0.60 A, the second distance may range from 0.56 A to 2.10 A, the third distance may range from 0.08 A to 0.30 A, the fourth distance may range from 0.56 A to 2.10 A, and "A" may be the diameter of a light emission surface of the light-emitting element.

The diameter of the first lens may be larger than a diameter of a light emission surface of the light-emitting element.

Each of the first distance and the third distance may be smaller than a diameter of a light emission surface of the light-emitting element.

The lighting device may further include a cover member configured to accommodate the lens array therein, and a heat radiation unit connected to the cover member and including a heat radiation fin configured to radiate heat.

A lighting device according to a further embodiment includes a light-emitting module including a circuit board and a light-emitting element disposed on the circuit board, a first lens including a first light entrance surface facing the light-emitting element and a first light exit surface, a second lens including a second light entrance surface facing the first light exit surface and a second light exit surface, a third lens including a third light entrance surface facing the second light exit surface and a third light exit surface, and a fourth lens including a fourth light entrance surface facing the third light exit surface and a fourth light exit surface, wherein the first to fourth lenses are sequentially arranged in a first direction, wherein each of the first light exit surface and the second light exit surface is convex toward the first direction, wherein each of the third light entrance surface and the fourth light entrance surface is convex toward a direction opposite the first direction, wherein the first light exit surface and the fourth light entrance surface have the same curvature, and the second light exit surface and the third light entrance surface have the same curvature, and wherein the first direction is a direction from the light-emitting element toward the first lens.

Advantageous Effects

Embodiments may obtain cumulative power equal to or greater than 60% and may reduce manufacturing costs.

DESCRIPTION OF DRAWINGS

FIG. 5 illustrates total cumulative power depending on variation in the diameter of the light emission surface of the light-emitting element illustrated in FIG. 4.

FIG. 7 illustrates the results of simulation related to total cumulative power depending on variation in the Conic constant of each of first to fourth lenses having an elliptical curvature.

FIG. 8 illustrates total cumulative power when the diameter of the light exit surface of the light-emitting element is 2.5 mm, 5.0 mm, and 10.0 mm.

FIG. 9 illustrates the sizes of the first and second lenses depending on the diameter of the light exit surface of FIG. 8.

BEST MODE

Figure 1:
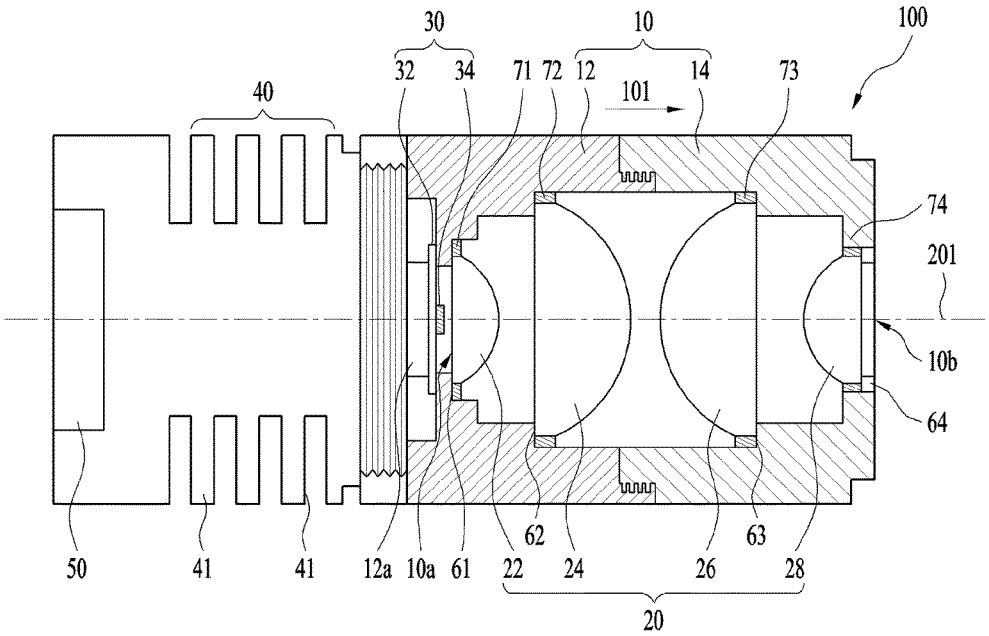
FIG. 1 illustrates a cross-sectional view of a lighting device according to an embodiment.

Hereinafter, embodiments will be clearly revealed via a description related to the accompanying drawings and embodiments. In the description of the embodiments, when an element is referred to as being formed "on" or "under" another element, it can be directly "on" or "under" the other element or be indirectly formed with intervening elements therebetween. It will also be understood that "on" or "under" the element may be described relative to the drawings.

In the drawings, the size are exaggerated, omitted or schematically illustrated for clarity and convenience of description. In addition, the size of each constituent element does not wholly reflect an actual size thereof. In addition, the same reference numerals designate the same elements throughout the description of the drawings.

FIG. 1 illustrates a cross-sectional view of a lighting device 100 according to an embodiment.

Referring to FIG. 1, the lighting device 100 includes a cover member 10, a lens array 20 including first to fourth lenses 22 to 28, a light-emitting module 30, a heat radiation unit 40, and a power supply unit 50.

The cover member 10 accommodates the lens array 20 therein, and protects the lens array 20 from external shocks.

The cover member 10 may have a hollow structure including a first opening 10*a*, into which light is introduced, and a second opening 10*b*, from which light is emitted, and may include seating portions 61 to 64 on which the lens array 20 is disposed.

The cover member 10 may include a first seating portion 61, on which the edge of the first lens 22 is seated, a second seating portion 62, on which the edge of the second lens 24 is seated, a third seating portion 63, on which the edge of the third lens 26 is seated, and a fourth seating portion 64, on which the edge of the fourth lens 28 is seated.

The first to fourth seating portions 61 to 64 of the cover member 10 may be provided with fixing portions 71 to 74, by which the first to fourth lenses 22 to 28 are supported or fixed.

For example, the cover member 10 may include first and second covers 12 and 14 connected to each other, the first and second lenses 22 and 24 may be disposed in the first cover 12, and the third and fourth lenses 26 and 28 may be disposed in the second cover 14.

The first cover 12 may be provided on one end thereof with a first screw-thread, and the second cover 14 may be provided on one end thereof with a second screw-thread.

The first and second screw-threads may be engaged with each other. The distance between the second lens 24 and the third lens 26 may be adjusted by varying the degree of coupling of the first screw-thread and the second screw-thread.

In addition, in another embodiment, the first cover 12 may be divided into first and second portions (not illustrated). The first seating portion 61 may be provided on the first portion, and a third screw-thread may be provided on one end of the first portion. The second seating portion 62 may be provided on the second portion, and a fourth screw-thread may be provided on one end of the second portion so as to be engaged with the third screw-thread. The distance between the first lens 22 and the second lens 24 may be adjusted by varying the degree of coupling of the third screw-thread and the fourth screw-thread.

The second cover 14 may be divided into third and fourth portions (not illustrated). The third seating portion 63 may be provided on the third portion, and a fifth screw-thread may be provided on one end of the third portion. The fourth seating portion 64 may be provided on the fourth portion, and a sixth screw-thread may be provided on one end of the fourth portion so as to be engaged with the fifth screw-thread. The distance between the third lens 26 and the fourth lens 28 may be adjusted by varying the degree of coupling of the fifth screw-thread and the sixth screw-thread.

The light-emitting module 30 generates light when receiving a voltage or a control signal from the power supply unit 50, and emits the generated light to the lens array 20.

The light-emitting module 30 may include a circuit board 32, to which a voltage is supplied from the power supply unit 50, and a light-emitting element 34 disposed on the circuit board 32.

The circuit board 32 may be a printed circuit board, a metal PCB, or a flexible PCB. The first cover 12 may be provided on one end thereof adjacent to the first opening 10*a* with a support portion 12*a*, which supports the circuit board 32. The circuit board 32 may be disposed on the support portion 12*a* so that the light-emitting element 34 faces the lens array 20.

The light-emitting element 34 is disposed on one surface (e.g. the upper surface) of the circuit board 32.

The light-emitting element 34 may be a light-emitting diode (LED) based light source, without being limited thereto. For example, the light-emitting element 34 may have a light-emitting diode chip form or a light-emitting diode package form.

The light-emitting element 34 may be one or more light-emitting diodes. For example, a single light-emitting element 34 may be disposed on the circuit board 32, or a plurality of light-emitting elements 34 may be arranged in a line, in a circular form, or in a matrix shape on the circuit board 32.

The light-emitting element 34 may generate ultraviolet light in a wavelength range from 200 nm to 400 nm. Alternatively, for example, the light-emitting element 34 may generate ultraviolet-C (UVC) light in a wavelength range from 200 nm to 280 nm.

For example, the light-emitting element 34 may include a substrate, a light-emitting structure, which is disposed on the substrate and includes a first conductive (e.g. n-type) semiconductor layer, an active layer, and a second conductive (e.g. p-type) semiconductor layer, and first and second electrodes electrically connected to the light-emitting structure, and may emit light via recombination of electrons and holes introduced into the active layer.

The light-emitting module 30 may be disposed close to the first opening 10*a* in the cover member 10, and the light-emitting element 34 may be disposed so as to be opposite the first opening 10*a* and may emit light to the lens array 20 through the first opening 10*a*.

The lens array 20 may include the first to fourth lenses 22 to 28, which are sequentially arranged in a line in a first direction 101. Here, the first direction 101 may be the direction from the first opening 10*a* toward the second opening 10*b* or from the light-emitting element 34 toward the first lens 22.

The first to fourth lenses 22 to 28 may be sequentially arranged in a line in the first direction 101. For example, the centers of the first to fourth lenses 22 to 28 may be aligned with an imaginary line 201 that is parallel to the first direction 101.

The heat radiation unit 40 may be connected to the cover member 10 and may radiate heat generated from the cover member 10. In order to increase heat radiation efficiency, the heat radiation unit 40 may include heat radiation fins 41 on the outer circumferential surface thereof.

The heat generated by heat emission of the light-emitting element 34 may be transferred to the heat radiation unit 40 through the circuit board 32, and the heat radiation unit 40 may radiate the heat transferred through the heat radiation fins 41 to the outside.

The power supply unit 50 provides the light-emitting module 30 with a voltage or a control signal for driving the light-emitting element 34. For example, the power supply unit 50 may be disposed under the heat radiation unit 40 and may be electrically connected to the circuit board 32.

Figure 2:
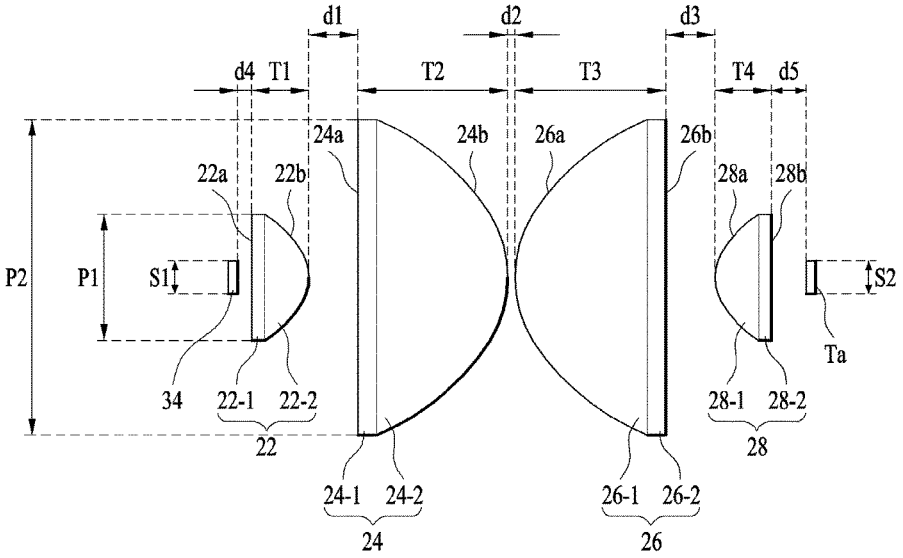
FIG. 2 illustrates the placement of a light-emitting element, first to fourth lenses, and a target illustrated in FIG. 1.

FIG. 2 illustrates the placement of the light-emitting element 34, the first to fourth lenses 22 to 28, and a target Ta illustrated in FIG. 1. Here, the target Ta may be a light receiving device, an optical fiber, an optical cable, an exposure device, a detector, an endoscope, a sensor, or the like, without being limited thereto.

Referring to FIG. 2, the lens array 20 serves to concentrate the light emitted from the light-emitting element 34 to the target Ta.

The lens array 20 may include the first lens 22, the second lens 24, the third lens 26, and the fourth lens 28, which are sequentially arranged in a line in the first direction.

The first and second lenses 22 and 24 serve to refract the light emitted from the light-emitting element 34 having Lambertian distribution so as to make parallel light.

The third and fourth lenses 26 and 28 may focus the parallel light, formed by the first and second lenses 22 and 24, on the target Ta, which is located at a predetermined distance from the lens array 20 and has a predetermined area.

The first lens 22 and the fourth lens 28 may have the same shape, or may be arranged in opposite directions.

For example, the first lens 22 and the fourth lens 28 may be the same as each other in all of the diameter, the thickness, and the curvature thereof.

For example, the first lens 22 and the fourth lens 28 may have a convex lens form, but the first lens 22 may be disposed with a convex shape facing the first direction 101 and the fourth lens 28 may be disposed with a convex shape facing the direction opposite the first direction.

The second lens 24 and the third lens 26 may have the same shape, or may be arranged in opposite directions.

For example, the second lens 24 and the third lens 26 may be the same as each other in all of the diameter, the thickness, and the curvature thereof.

For example, the second lens 24 and the third lens 26 may have a convex lens form, but the second lens 24 may be disposed with a convex shape facing the first direction 101 and the third lens 26 may be disposed with a convex shape facing the direction opposite the first direction.

The first lens 22 may be disposed close to the first opening 10*a* and may include a first portion 22-1 having a first light entrance surface 22*a*, on which the light from the light-emitting element 34 is incident, and a second portion 22-2 having a first light exit surface 22*b*, from which the light incident on the first light entrance surface 22*a* is discharged.

For example, the first light entrance surface 22*a* of the first lens 22 may face the light-emitting element 34.

The first light entrance surface 22*a* of the first lens 22 may be an aspherical surface, for example, a flat surface, and the first light exit surface 22*b* of the first lens 22 may be a curved surface that is convex toward the first direction 101.

For example, the first light exit surface 22*b* of the first lens 22 may have an elliptical shape.

For example, the diameter of the first portion 22-1 of the first lens 22 may be the same as the diameter of the first light entrance surface 22*a*, and may be constant. The thickness of the first portion 22-1 of the first lens 22 may be smaller than the maximum thickness of the second portion 22-2 of the first lens 22. For example, the maximum thickness of the second portion 22-2 of the first lens 22 may be the maximum distance from the lower surface of the second portion 22-2 to the first light exit surface 22*b* of the first lens 22.

In another embodiment, the first portion 22-1 of the first lens 22 may be omitted.

The second lens 24 may include a first portion 24-1 having a second light entrance surface 24*a*, on which the light from the first light exit surface 22*b* of the first lens 22 is incident, and a second portion 24-2 having a second light exit surface 24*b*, from which the light incident on the second light entrance surface 24*a* is discharged.

For example, the second light entrance surface 24*a* of the second lens 24 may face the first light exit surface 22*b* of the first lens 22. The second light entrance surface 24*a* of the second lens 24 may be an aspherical surface, for example, a flat surface, and the second light exit surface 24*b* of the second lens 24 may be a curved surface that is convex toward the first direction 101.

For example, the second light exit surface 24*b* of the second lens 24 may have an elliptical shape.

For example, the diameter of the first portion 24-1 of the second lens 24 may be the same as the diameter of the second light entrance surface 24*a*, and may be constant.

The thickness of the first portion 24-1 of the second lens 24 may be smaller than the maximum thickness of the second portion 24-2 of the second lens 24. For example, the maximum thickness of the second portion 24-2 of the second lens 24 may be the maximum distance from the lower surface of the second portion 24-2 to the second light exit surface 24*b* of the second lens 24.

In another embodiment, the first portion 24-1 of the second lens 24 may be omitted.

The third lens 26 may include a first portion 26-1 having a third light entrance surface 26*a*, on which the light from the second light exit surface 24*b* of the second lens 24 is incident, and a second portion 26-2 having a third light exit surface 26*b*, from which the light incident on the third light entrance surface 26*a* is discharged.

The third light entrance surface 26*a* of the third lens 26 may face the second light exit surface 24*b* of the second lens 24.

The first portion 26-1 of the third lens 26 and the second portion 24-2 of the second lens 24 may have the same shape, and may be disposed so as to be convex toward opposite directions.

The second portion 26-2 of the third lens 26 and the first portion 24-1 of the second lens 24 may have the same shape.

A description related to the shape of the second lens 24 may be equally applied to the shape of the third lens 26.

The third light entrance surface 26*a* of the third lens 26 may correspond to the second light exit surface 24*b* of the second lens 24, and the third light exit surface 26*b* of the third lens 26 may correspond to the second light entrance surface 24*a* of the second lens 24.

The fourth lens 28 may include a first portion 28-1 having a fourth light entrance surface 28*a*, on which the light from the third light exit surface 26*b* of the third lens 26 is incident, and a second portion 28-2 having a fourth light exit surface 28*b*, from which the light incident on the fourth light entrance surface 28*a* is discharged.

The fourth light entrance surface 28*a* of the fourth lens 28 may face the third light exit surface 26*b* of the third lens 26.

The first portion 28-1 of the fourth lens 28 and the second portion 22-2 of the first lens 22 may have the same shape, and may be disposed so as to be convex toward opposite directions. The second portion 28-2 of the fourth lens 28 and the first portion 22-1 of the first lens 22 may have the same shape.

The fourth light entrance surface 28*a* of the fourth lens 28 may correspond to the second light exit surface 22*b* of the first lens 22, and the fourth light exit surface 28*b* of the fourth lens 28 may correspond to the first light entrance surface 22*a* of the first lens 22.

A description related to the shape of the first lens 22 may be equally applied to the shape of the fourth lens 28, and a description related to the shape of the second lens 24 may be equally applied to the shape of the third lens 26.

Each of the first light exit surface 22*b* and the second light exit surface 24*b* may be convex toward the first direction 101, and the third light entrance surface 26*a* and the fourth light entrance surface 28*a* may be convex toward the direction opposite the first direction 101.

In addition, the first light exit surface 22*b* and the fourth light entrance surface 28*a* may have the same curvature, and the second light exit surface 24*b* and the third light entrance surface 26*a* may have the same curvature.

The diameter P1 of the first lens 22 may range from 2.00 A to 6.00 A.

For example, the diameter of the first lens 22 may be the diameter P1 of the first light entrance surface 22*a*, and may be 4.00 A. Here, "A" may be the diameter S1 of the light emission surface of the light-emitting element 34. For example, "A" may be the maximum diameter of the light emission surface of the light-emitting element 34.

For example, the diameter P1 of the first lens 22 may be larger than the diameter S1 of the light emission surface of the light-emitting element 34.

The thickness T1 of the first lens 22 may range from 0.80 A to 2.40 A.

For example, the thickness T1 of the first lens 22 may be the sum of the thicknesses of the first portion 22-1 and the second portion 22-2, and may be 1.60 A.

The curvature of the first lens 22 may range from 0.95 A to 2.85 A. For example, the curvature of the first lens 22 may be the curvature of the first light exit surface 22*b* of the first lens 22, and may be 1.90 A.

In the lens formula for defining the first lens 22, which has an elliptical shape, the conic constant may range from −0.44 to −0.73.

The diameter P2 of the second lens 24 may range from 4.00 A to 15.00 A.

For example, the diameter of the second lens 24 may be the diameter P2 of the second light entrance surface 24*a*, and may be 10.00 A.

The thickness T2 of the second lens 24 may range from 1.68 A to 6.30 A.

For example, the thickness T2 of the second lens 24 may be the sum of the thicknesses of the first portion 24-1 and the second portion 24-2, and may be 4.20 A.

For example, the thickness T2 of the second lens 24 may be larger than the thickness T1 of the first lens 22 (T2>T1).

The curvature of the second lens 24 may range from 1.67 A to 6.27 A. For example, the curvature of the second lens 24 may be the curvature of the second light exit surface 24*b* of the second lens 24, and may be 4.18 A.

In the lens formula for defining the second lens 24, which has an elliptical shape, the conic constant may range from −0.44 to −0.73.

The distance d4 between the light emission surface of the light-emitting element 34 and the first light entrance surface 22*a* of the first lens 22 is smaller than the diameter S1 of the light emission surface of the light-emitting element 34 (d4<d1).

For example, the distance d4 between the light emission surface of the light-emitting element 34 and the first light entrance surface 22*a* of the first lens 22 may range from 0.16 A to 0.60 A. For example, "d4" may be 0.40 A.

The distance d2 between the second lens 24 and the third lens 26 is smaller than the diameter S1 of the light emission surface of the light-emitting element 34 (d2<S1).

The distance d2 between the second lens 24 and the third lens 26 may be shorter than the distance d1 between the first lens 22 and the second lens 24 (d2<d1).

The distance d1 between the first light exit surface 22*b* of the first lens 22 and the second light entrance surface 24*a* of the second lens 24 may range from 0.56 A to 2.10 A. For example, "d1" may be the distance from the distal end of the first light exit surface 22*b* of the first lens 22 to the second light entrance surface 24*a* of the second lens 24, and may be 1.40 A.

The distance d2 between the second lens 24 and the third lens 26 may range from 0.08 A to 0.30 A. "d2" may be the distance from the distal end of the second light exit surface 24*b* of the second lens 24 to the distal end of the third light entrance surface 26*a* of the third lens 26. For example, "d2" may be 0.20 A.

For example, the distal end of the second light exit surface 24*b* may be the portion in which the distance from the second light entrance surface 24*a* to the second light exit surface 24*b* is the maximum, and the distal end of the third light entrance surface 26*a* may be the portion in which the distance from the third light exit surface 26*b* to the third light entrance surface 26*a* is the maximum.

The distance d3 between the third lens 26 and the fourth lens 28 may range from 0.56 A to 2.10 A. "d3" may be the distance from the third light exit surface 26*b* of the third lens 26 to the fourth light entrance surface 28*a* of the fourth lens 28. For example, "d3" may be 1.40 A.

The distance d5 between the fourth lens 28 and the target Ta may range from 0.40 A to 1.50 A. For example, "d5" may be the distance from the fourth light exit surface 28*b* of the fourth lens 28 to the target Ta. For example, "d5" may be 1.00 A.

The diameter P1 of the first lens 22 may be smaller than the diameter P2 of the second lens 24.

For example, the diameter P1 of the first light entrance surface 22*a* of the first lens 22 may be smaller than the diameter P2 of the second light entrance surface 24*a* of the second lens 24 (P1<P2).

The first lens 22 and the second lens serve to sequentially collect light. Since the angle of the light to be emitted is increased by the first lens 22, the diameter P2 of the second lens 24 needs to be larger than the diameter P1 of the first lens 22.

In addition, the distance d2 between the second lens 24 and the third lens 26 may be shorter than the distance d1 between the first lens 22 and the second lens 24 and the distance d3 between the third lens 26 and the fourth lens 28 (d2<d1 and d2<d3). In addition, "d1" and "d3" may be the same.

For example, the diameter S2 of the target Ta may be the same as the diameter S1 of the light emission surface of the light-emitting element 34, without being limited thereto.

Figures 3, 4:
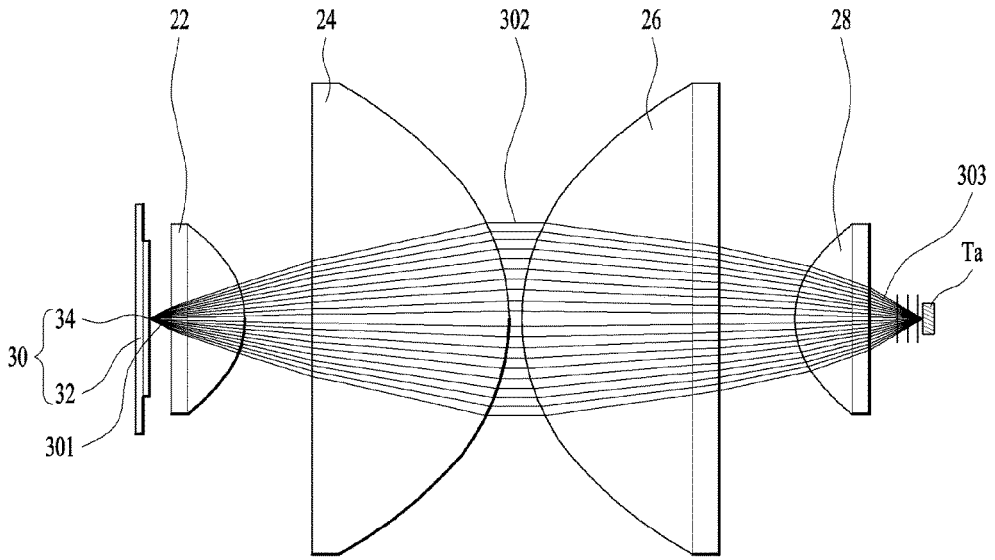
FIG. 3 illustrates that light emitted from the light-emitting element 34 illustrated in FIG. 1 is concentrated on the target through a lens array.
FIG. 4 illustrates the size of each of lenses and the distance between the lenses depending on variation in the diameter of a light emission surface of the light-emitting element.

FIG. 3 illustrates that light emitted from the light-emitting element 34 illustrated in FIG. 1 is concentrated on the target Ta through the lens array 20.

Referring to FIG. 3, light 301 emitted from the light-emitting element 34 may be refracted by the first and second lenses 22 and 24 to thereby become parallel light 302, and the parallel light 302 may be refracted by the third and fourth lenses 26 and 28 to thereby become light 303 that is converged or focused on the target Ta.

FIG. 4 illustrates the size of each of the lenses 22 to 28 and the distances d1 to d5 between the lenses 22 to 28 depending on variation in the diameter S1 of the light emission surface LES of the light-emitting element 34. Only the sizes of the first and second lenses 22 and 24 are illustrated in FIG. 4, but the size of the third lens 26 is the same as the size of the second lens 24 and the size of the fourth lens 28 is the same as the size of the first lens 22, and thus the sizes thereof are omitted.

FIG. 5 illustrates total cumulative power depending on variation in the diameter S1 of the light emission surface LES of the light-emitting element 34 illustrated in FIG. 4. Here, "total cumulative power" indicates the power collected by a detector, which is the target Ta, relative to all of the light emitted from the lighting device 100. "Center" indicates the total cumulative power detected in the target Ta, "Front" indicates the total cumulative power detected at a predetermined point in front of the target Ta, and "Back" indicates the total cumulative power detected at a predetermined point behind the target Ta. The results of simulation related to the total cumulative power "Front" and "Back" serve to increase the reliability of the detected result related to "Center".

Referring to FIGS. 4 and 5, when the diameter S1 of the light emission surface LES of the light-emitting element 34 ranges from 0.5 A to 1.5 A, the total cumulative power in the target Ta may be equal to or greater than 60%, and the total cumulative power "Front" or "Back" may be equal to or greater than 50%. FIG. 5 illustrates the results of simulation when "A" is 2.5 mm.

Figure 6:
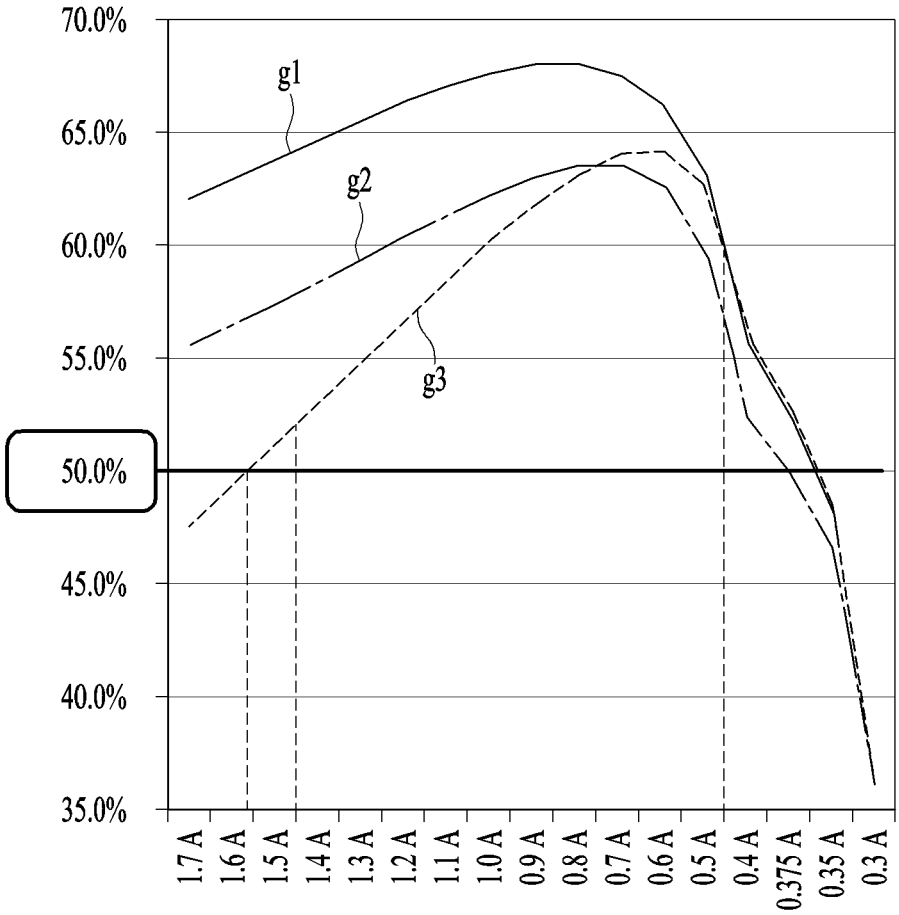
FIG. 6 illustrates a graph related to the results of simulation of FIG. 5.

FIG. 6 illustrates a graph related to the results of simulation of FIG. 5. The X-axis represents the diameter of the light emission surface of the light-emitting element, and the Y-axis represents total cumulative power. "g1" indicates total cumulative power for the target Ta, "g2" indicates total cumulative power "Back", and "g3" indicates total cumulative power "Front".

Referring to "g1", when the diameter S1 of the light emission surface is less than 0.5 A, the total cumulative power in the target Ta may be less than 60%. In addition, referring to "g3", the total cumulative power "Front" may be less than 50% when the diameter S1 of the light emission surface is 1.6 A, but may be equal to or greater than 50% when the diameter S1 of the light emission surface is 1.5 A.

Thus, the diameter S1 of the light emission surface LES of the light-emitting element 34 may range from 0.5 A to 1.5 A, the diameter, thickness, and curvature of each of the first to fourth lenses 22 to 28 may be defined as illustrated in FIG. 4, and the distances d1 to d3 between the first to fourth lenses 22 to 28, the distance d4 between the light emission surface and the first lens, and the distance d5 between the fourth lens 28 and the target Ta may be defined as illustrated in FIG. 4.

The light concentrated on the target Ta via the lens array 20 described above may have total cumulative power equal to or greater than 60%, and the total cumulative power "Front" or "Back" may be equal to or greater than 50%.

FIG. 7 illustrates the results of simulation related to total cumulative power depending on variation in the Conic constant (C) of each of the first to fourth lenses 22 to 28 having an elliptical curvature. In FIG. 7, the diameter S1 of the light emission surface of the light-emitting element 34 is 2.5 mm. The conic constant of each of the first to fourth lenses 22 to 28 may be the same, and in the simulation, the conic constant varies so that all of the lenses have the same conic constant C.

Here, "Center", "Front", and "Back" may be obtained as follows:

$Front=0.3004-1.687\times C-1.917\times C^2$, $Back=1.020+3.915\times C+8.58\times C^2+5.37\times C^3$, and $Center=0.959+2.918\times C+7.19\times C^2+5.257\times C^3$.

When the Conic constant (C) of each of the first to fourth lenses 22 to 28 ranges from −0.44 to −0.73, the total cumulative power in the target Ta may be equal to or greater than 60%, and the total cumulative power "Front" or "Back" may be equal to or greater than 50%.

FIG. 8 illustrates total cumulative power when the diameter S1 of the light emission surface of the light-emitting element 34 is 2.5 mm, 5.0 mm, and 10.0 mm, and FIG. 9 illustrates the sizes of the first and second lenses 22 and 24 depending on the diameter S1 of the light emission surface of FIG. 8. The size of the third lens 26 may be the same as the size of the second lens 24, and the size of the fourth lens 28 may be the same as the size of the first lens 22.

Referring to FIG. 8, when "S1" is 2.5 mm, 5.0 mm, and 10.0 mm, the sizes of the first to fourth lenses 22 to 28 may be the same as what is illustrated in FIG. 9, the total cumulative power in the target Ta may be equal to or greater than 60%, and the total cumulative power "Front" or "Back" may be equal to or greater than 50%.

A lens array, which is used as an optical system to condense light and transmit the same to a target, may include various types of lenses depending on the shape thereof, and in general, a plastic lens is used depending on the characteristics of the application and a light source.

However, in the case of an application using an UV light source, since the plastic lens is damaged by ultraviolet light, a glass lens is used in the application using the UV light source, instead of a plastic lens. Such a glass lens requires a large mold for molding. In addition, since various molds are required in order to produce various shapes of glass lenses for light concentration, manufacturing costs are increased.

However, owing to the provision of the lens array 20 including lenses of the same size (e.g., the first lens and the fourth lens having the same size and the second lens and the third lens having the same lens), the lens array may be configured with two types of lenses. Due to this, the embodiments may reduce costs for the manufacture of molds.

In addition, since the sizes of the first to fourth sizes 22 to 28, the distances d1 to d3 between the first to fourth lenses 22 to 28, the distance d4 between the lens array 20 and the light emission surface, and the distance d5 between the lens array 20 and the target Ta are defined based on the diameter S1 of the light emission surface of the light-emitting element 34, as described above with reference to FIGS. 5 to 9, the embodiments may ensure that the total cumulative power in the target Ta is equal to or greater than 60% and that the total cumulative power "Front" or "Back" is equal to or greater than 50%.

The above description merely describes the technical sprit of the embodiments by way of example, and various modifications and substitutions related to the above description are possible by those skilled in the art without departing from the scope and spirit of the disclosure. Accordingly, the disclosed embodiments are provided for the purpose of description and are not intended to limit the technical scope of the disclosure, and the technical scope of the disclosure is not limited by the embodiments. The range of the disclosure should be interpreted based on the following claims, and all technical ideas that fall within the range equivalent to the claims should be understood as belonging to the scope of the disclosure.

INDUSTRIAL APPLICABILITY

Embodiments may be used in a lighting device, which may obtain total cumulative power equal to or greater than 60% and may reduce manufacturing costs.

The invention claimed is:

1. A lighting device comprising:

a light-emitting element configured to emit light; and a lens array comprising first to fourth lenses sequentially arranged in a line in a first direction, wherein the first lens and the fourth lens have the same shape, and the second lens and the third lens have the same shape, wherein the first lens includes a first light entrance surface facing the light-emitting element and a first light exit surface which is convex toward the first direction, wherein the second lens includes a second light entrance surface facing the first light exit surface and a second light exit surface which is convex toward the first direction, wherein the third lens includes a third light entrance surface facing the second light exit surface and being convex toward a second direction opposite the first direction and a third light exit surface for discharging the light incident on the third light entrance surface, wherein the fourth lens includes a fourth light entrance surface facing the third light exit surface and being convex toward the second direction and a fourth light exit surface for discharging the light incident on the fourth light entrance surface, wherein the first direction is a direction from the light-emitting element toward the first lens, wherein each of the first light entrance surface, the second light entrance surface, the third light exit surface, and the fourth light exit surface is a flat surface, wherein the first light exit surface includes a first curved surface which is convex in the first direction, wherein the second light exit surface includes a second curved surface which is convex in the first direction, wherein the third light entrance surface includes a third curved surface which is convex in the second direction, and wherein a distance between the second curved surface and the third curved surface is smaller than a distance between the first curved surface and the second light entrance surface of the second lens.

2. The lighting device according to claim 1, wherein the first lens and the fourth lens have the same diameter, thickness, and curvature, and wherein the second lens and the third lens have the same diameter, thickness, and curvature.

3. The lighting device according to claim 1, wherein a diameter of the first lens is smaller than a diameter of the second lens.

4. The lighting device according to claim 1, wherein a diameter of the first lens ranges from 2.00 A to 6.00 A, a diameter of the second lens ranges from 4.00 A to 15.00 A, and "A" is a diameter of a light emission surface of the light-emitting element.

5. The lighting device according to claim 1, wherein a thickness of the first lens ranges from 0.80 A to 2.40 A, a thickness of the second lens ranges from 1.68 A to 6.30 A, and "A" is a diameter of a light emission surface of the light-emitting element.

6. The lighting device according to claim 1, wherein each of the first and second lenses has an elliptical shape, and a conic constant of each of the first and second lenses ranges from −0.44 to −0.73.

7. The lighting device according to claim 1, wherein a distance between a light emission surface of the light-emitting element and the first lens ranges from 0.16 A to 0.60 A, a distance between the fourth lens and a target ranges from 0.40 A to 1.50 A, and "A" is a diameter of the light emission surface of the light-emitting element.

8. The lighting device according to claim 1, wherein a distance between the first lens and the second lens ranges from 0.56 A to 2.10 A, a distance between the second lens and the third lens ranges from 0.08 A to 0.30 A, a distance between the third lens and the fourth lens ranges from 0.56 A to 2.10 A, and "A" is a diameter of a light emission surface of the light-emitting element.

9. The lighting device according to claim 1, wherein a curvature of the first lens ranges from 0.95 A to 2.85 A, a curvature of the second lens ranges from 1.67 A to 6.27 A, and "A" is a diameter of a light emission surface of the light-emitting element.

10. The lighting device according to claim 1, wherein a diameter of the first lens is 4.00 A, a diameter of the second lens is 10.00 A, a curvature of the first lens is 1.60 A, a curvature of the second lens is 4.18 A, and "A" is a diameter of a light emission surface of the light-emitting element.

11. The lighting device according to claim 10, wherein a distance between a light emission surface of the light-emitting element and the first lens is 0.40 A, a distance between the first lens and the second lens is 1.40 A, a distance between the second lens and the third lens is 0.20 A, a distance between the third lens and the fourth lens is 1.40 A, and "A" is a diameter of a light emission surface of the light-emitting element.

12. The lighting device according to claim 1, wherein the light-emitting element generates ultraviolet light in a wavelength range from 200 nm to 400 nm.

13. A lighting device comprising:

a light-emitting module comprising a circuit board and a light-emitting element disposed on the circuit board; and a lens array comprising first to fourth lenses sequentially arranged in a line in a first direction, wherein the first lens and the fourth lens have the same shape, and the second lens and the third lens have the same shape, wherein the first direction is a direction from the light-emitting element toward the first lens, wherein the first lens comprises:

a first light entrance surface having a first flat surface facing the light-emitting element; and a first light exit surface having a first curved surface which is convex toward the first direction wherein the second lens comprises:

a second light entrance surface having a second flat surface facing the first light exit surface; and a second light exit surface having a second curved surface which is convex toward the first direction, wherein the third lens comprises:

a third light entrance surface having a third curved surface facing the second light exit surface and being convex toward a second direction opposite the first direction; and a third light exit surface having a third flat surface for discharging the light incident on the third light entrance surface, wherein the fourth lens comprises:

a fourth light entrance surface having a fourth curved surface facing the third light exit surface and being convex toward the second direction; and a fourth light exit surface having a fourth flat surface for discharging the light incident on the fourth light entrance surface, wherein a diameter of the first light entrance surface is smaller than a diameter of the second light entrance surface, wherein a first distance between the light-emitting element and the first flat surface is smaller than a second distance between the first curved surface and the second flat surface, wherein a third distance between the second curved surface and the third curved surface is smaller than the second distance, and wherein a fourth distance between the third flat surface and the fourth curved surface is the same as the second distance.

14. The lighting device according to claim 13, wherein the diameter of the first light entrance surface ranges from 2.00 A to 6.00 A, the diameter of the second light entrance surface ranges from 4.00 A to 15.00 A, a thickness of the first lens ranges from 0.80 A to 2.40 A, a thickness of the second lens ranges from 1.68 A to 6.30 A, a curvature of the first light exit surface ranges from 0.95 A to 2.85 A, a curvature of the second light exit surface ranges from 1.67 A to 6.27 A, and "A" is a diameter of a light emission surface of the light-emitting element.

15. The lighting device according to claim 13, wherein the first distance ranges from 0.16 A to 0.60 A, the second distance ranges from 0.56 A to 2.10 A, the third distance ranges from 0.08 A to 0.30 A, the fourth distance ranges from 0.56 A to 2.10 A, and "A" is a diameter of a light emission surface of the light-emitting element.

16. The lighting device according to claim 13, wherein the diameter of the first light entrance surface is larger than a diameter of a light emission surface of the light-emitting element.

17. The lighting device according to claim 13, wherein each of the first distance and the third distance is smaller than a diameter of a light emission surface of the light-emitting element.

18. The lighting device according to claim 13, further comprising:

a cover member configured to accommodate the lens array therein; and a heat radiation unit connected to the cover member and comprising a heat radiation fin configured to radiate heat.

19. A lighting device comprising:

a light-emitting module comprising a circuit board and a light-emitting element disposed on the circuit board; and a lens array consisting of:

a first lens comprising a first light entrance surface facing the light-emitting element and a first light exit surface;

a second lens comprising a second light entrance surface facing the first light exit surface and a second light exit surface;

a third lens comprising a third light entrance surface facing the second light exit surface and a third light exit surface; and a fourth lens comprising a fourth light entrance surface facing the third light exit surface and a fourth light exit surface, wherein the first to fourth lenses are sequentially arranged in a first direction, wherein each of the first light exit surface and the second light exit surface is convex toward the first direction, wherein each of the third light entrance surface and the fourth light entrance surface is convex toward a direction opposite the first direction, wherein each of the first light entrance surface, the second light entrance surface, the third light exit surface, and the fourth light exit surface is a flat surface, wherein the first light exit surface and the fourth light entrance surface have the same curvature, and the second light exit surface and the third light entrance surface have the same curvature, and wherein the first direction is a direction from the light-emitting element toward the first lens.

* * * * *